United States Patent [19]

Theurer

[11] Patent Number: 4,628,822

[45] **Date of Patent: * Dec. 16, 1986**

[54] CONTINUOUSLY ADVANCING TRACK LEVELING, LINING AND TAMPING MACHINE

[75] Inventor: Josef Theurer, Vienna, Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 618,238

[22] Filed: Jun. 7, 1984

[30] Foreign Application Priority Data

Sep. 28, 1983 [AT] Austria ..... 3455/83

[51] Int. Cl.[4] ..... E01B 27/17

[52] U.S. Cl. ..... 104/7.2; 104/12

[58] Field of Search ..... 104/2, 7 R, 7 B, 12

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,595,170 | 7/1971 | Plasser et al. | 104/12 |
| 3,795,198 | 3/1974 | Plasser et al. | 104/12 |
| 4,094,250 | 6/1978 | Theurer | 104/12 |
| 4,356,771 | 11/1982 | Theurer | 104/7 B |
| 4,404,913 | 9/1983 | Theurer | 104/12 |
| 4,457,234 | 7/1984 | Theurer et al. | 104/7 B |

OTHER PUBLICATIONS

09-CSM Advertisement, "Der Eisenbahningenieur", No. 6, Jun. 1983.

*Primary Examiner*—Randolph A. Reese
*Attorney, Agent, or Firm*—Kurt Kelman

[57] ABSTRACT

A continuously advancing machine for leveling, lining and tamping a track has a machine frame supported on undercarriages for continuous movement in an operating direction, a power plant and operating controls carried by the machine frame, and a tool carrier frame having a rear end supported on an undercarriage. A tamping tool assembly associated with each rail is mounted on the tool carrier frame immediately ahead of the undercarriage supporting the rear tool carrier frame end for tamping ballast in intermittent tamping cycles under the ties at points of intersection of the two rails and the ties. Each tamping tool assembly is vertically movably mounted on the tool carrier frame and includes two pairs of vibratory and reciprocatory tamping tools spaced from each other in the operating direction so that each pair of tools is in vertical alignment with a respective one of two successive cribs. A track lifting and lining unit is associated with the two rails mounted on the tool carrier frame ahead of the tamping tool assemblies and is arranged on the tool carrier frame between two undercarriages spaced in the direction of the track, and a longitudinally adjustable coupling pivotally connects the tool carrier frame to the machine frame for driving the tool carrier synchronously with the intermittent tamping cycles.

6 Claims, 6 Drawing Figures

CONTINUOUSLY ADVANCING TRACK LEVELING, LINING AND TAMPING MACHINE

Figure 1:
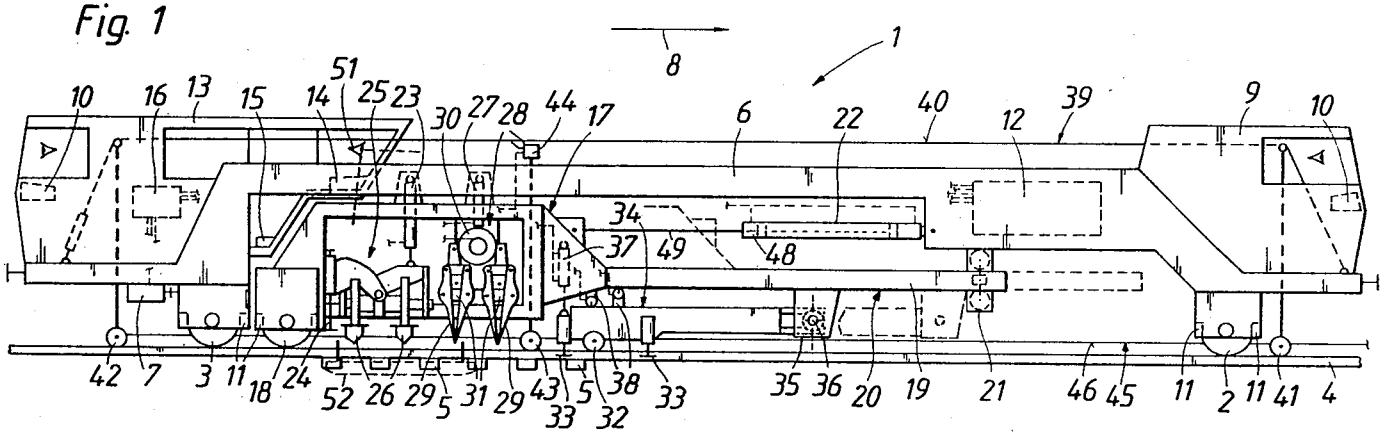

The present invention relates to improvements in a continuously advancing machine for leveling, lining and tamping a track consisting of two rails fastened to successive ties resting on ballast defining cribs between the successive ties, and more particularly to a machine of the type disclosed and claimed in my copending U.S. Pat. Nos. 4,534,295 and 4,596,193 both filed May 26, 1983. A model of such a non-stop advancing machine has been successfully built and operated, as reflected in an advertisement of the 09-CSM in "Der Eisenbahningenieur", No. 6, June 1983. The machine comprises a machine frame supported on undercarriages for continuous movement in an operating direction, a power plant and operating control means including drive means for continuously advancing the machine frame along the track in the operating direction and brake means for stopping the advance of the machine frame, the power plant and control means being carried by the machine frame, a tool carrier frame having a rear end supported on an undercarriage, standard tamping means mounted on the tool carrier frame immediately ahead of the undercarriage supporting the rear tool carrier frame end, in the operating direction, for tamping ballast in intermittent tamping cycles under respective ones of the ties at points of intersection of the two rails and the respective ties, track lifting and lining means associated with the two rails mounted on the tool carrier frame ahead of the tamping means in the operating direction and being arranged on the tool carrier frame between two of said undercarriages spaced in the direction of the track, track leveling and lining reference systems controlling the track lifting and lining means, and a longitudinally adjustable coupling pivotally connecting the tool carrier frame to the machine frame for driving the tool carrier frame synchronously with the intermittent tamping cycles.

In the development of continuously moving track leveling, lining and tamping machines, it is desirable to overcome or at least to reduce such phenomena necessarily connected with the stop-and-go advancement of the tamping heads between tamping cycles as the high stresses to which essential structual components of the machine are subjected due to the constant repetition of acceleration and braking as well as the physical stresses on the operating personnel due to the alternatingly accelerating and decelerating forces of the heavy masses moving along the track. Various structures have been proposed to enable mobile tampers to advance continuously along the track while performing intermittent tamping cycles but none of them has been successful in practical track maintenance operations.

U.S. Pat. No. 3,795,198, dated Mar. 5, 1974, also discloses a continuously advancing track tamper. In this machine, the tamping head associated with each rail is longitudinally displaceable along a guide on the machine frame and a track lifting unit is mounted on the machine frame ahead of the tamping heads. While the machine frame with the track lifting unit advances continuously, the tamping heads must remain stationary during each tamping cycle and must then be rapidly driven forwardly along their guides until the tamping tools are centered over the next tie to be tamped. This machine uses standard tamping heads for the simultaneous tamping of two successive ties, the two adjacent pairs of tamping tools being operated to pivot towards the ties which the pairs of tamping tools straddle so that the tamping tools execute a pincer movement towards the interposed tie. The machine frame must be massive to enable it to sustain not only the loads of the tamping heads with their guides and drives but also the operating forces of the vibratory tamping tools and the track lifting unit. A machine of this type also has not been built.

A commercially very successful track working machine has been disclosed in U.S. Pat. No. 4,356,771, dated Nov. 2, 1982, wherein a self-propelled and intermittently advancing standard track leveling, lining and tamping machine incorporating leveling and lining reference systems is coordinated with a self-propelled control vehicle which advances non-stop. The control vehicle is coupled to the machine by a distance monitoring device and the machine operation may be effected from an operator's cab on the control vehicle and observed there by television. The operator effecting the remote control works more comfortably because he is not subject to the stop-and-go impacts of the machine nor is he subject to the vibrations of the working forces of the tamping, lifting and lining tools. However, the provision of the additional control vehicle, with the required remote control and television devices, makes this installation so expensive that it can be economically used only for special track work, such as laying of new track or rehabilitation of track for high-speed traffic, in which the uniformity of the tie positioning and of the ballast condition permits the operation to be highly automated. This enables the operator on the control vehicle to effectuate his control functions on the basis of the television picture received from the operating area of the machine and without requiring the assistance of the operator riding on the machine.

The machine disclosed in my above-identified copending patents for the first time met the practical requirements and solved the problems encountered in the operation of a continuously advancing track leveling, lining and tamping machine. A substantial part of the weight and operating forces of the tamping, prack lifting and lining means is transmitted to the track through the undercarriage supporting the tool carrier frame for stop-and-go movement while the machine frame advances non-stop so that the latter is subjected to substantially smaller static and dynamic loads than in the machines proposed in the above-identified patents, wherein the individual tamping heads are longitudinally displaced on guides along the machine frame. At the same time, heavy impacts and vibrations are kept from the operator's cab on the machine frame so that the working conditions of the operator are considerably enchaned. This practical non-stop tamper has opened up a number of developmental possibilities and has initiated a new generation of track working machines.

U.S. Pat. No. 4,094,250, dated June 13, 1978, discloses a conventional, intermittently advancing track tamper equipped with tamping tool assemblies with four pairs of tamping tools spread apart towards the adjacent ties. Each tamping tool assembly is vertically movably mounted on the tamper machine frame and includes two pairs of vibratory and reciprocatory tamping tools spaced from each other in the operating direction so that each pair of tools is in vertical alignment with a respective one of two successive ones of the cribs whereby the tamping tools may be immersed in the respective cribs upon vertical movement of the tamping tool assembly, and the tools of each pair being pivotal in opposite directions for spreading towards a respective one of the ties defining the crib. This tamping tool assembly arrangement constitutes an improvement of the previously described type of arrangement wherein the tamping tools of each pair are squeezed together towards the interposed tie because their centering is easier and better because the tamping operation involves the immersion of tamping tools in only two, instead of three, adjacent cribs. In other words, the tamping tool assembly needs to be aligned only in relation to a single tie interposed between the two adjacent pairs of tamping tools.

An improved type of such a twin spreading tamping tool assembly is disclosed in my U.S. Pat. No. 4,404,913, dated Sept. 20, 1983, wherein two vibratory tamping tool supports are mounted on the vertically movable tamping tool carrier of the assembly for pivoting about an axis extending perpendicularly to the vertical plane defined by the rail and the supports extending to the left and to the right of the plane. The upper ends of the supports are linked to a common drive for vibrating the supports. The tamping tool pairs on one support are spaced from the tamping tool pairs on the other support so that each pair of the tamping tools is in vertical alignment with a respective one of the successive cribs between three successive ties. A drive on each support reciprocates the tamping tools of each pair towards and away from the elongated tie edges defining the respective cribs.

It is the primary object of this invention to improve the efficiency of a continuously advancing track leveling, lining and tamping machine of the first-described type without reducing the quality of the work.

The above and other objects are accomplished according to the invention by equipping the machine with tamping means comprising a respective tamping tool assembly associated with each rail, each tamping tool assembly being vertically movably mounted on the tool carrier frame and including two pairs of vibratory and reciprocatory tamping tools spaced from each other in the operating direction so that each pair of tools is in vertical alignment with a respective one of two successive ones of the cribs whereby the tamping tools of each pair may be immersed in the respective cribs upon vertical downward movement of the tamping tool assembly, and the tools of each pair being pivotal in opposite directions for spreading towards a respective one of the ties defining the crib.

This arrangement enables the great advantages of a continuously advancing tamper, with its increased working comfort, to be further enhanced by substantially decreasing the time needed for each tamping cycle, thus speeding the work of the machine without decreasing the quality of the work. The efficiency is increased, on the one hand, because the monitoring and centering of a total of four pairs of tamping tools per rail with respect to two successive ties requires much less time than the centering of the same number of tamping tools aligned with three successive cribs, as is the case with adjacent pairs of tamping tools which are squeezed together. On the other hand, the use of such twin spreading tamping tool assemblies intermittently advanced by two tie spacings provides a favorable relation between the relatively short advancing phase of the tool carrier frame and the total duration of the operating cycle obtained with the continuously advancing machine. Compared, for example, with the operation of such a machine equipped with a tamping tool assembly for tamping a single tie, only one centering and immersion of the tamping tools, braking and advancing of the tool carrier frame is required for accomplishing what the other machine needs double the effort.

Furthermore, since the length of the tamping tool assembly is substantially less than that of a twin assembly with squeezing tamping tools, the distance of the center of the assembly from the tool carrier frame rear end supporting undercarriage may be much less so that the tamping tools straddling each rail will be very accurately centered in relation thereto even in sharp curves so that it will not be necessary to displace the tamping tool assemblies laterally to achieve such centering. Also, since such tamping tool assemblies are relatively short, it is readily possible to arrange two such assemblies adjacent each other on the tool carrier frame for immersion of four pairs of tamping tools in successive cribs or, if desired, to position a crib compactor between the tamping tool assembly and the rear end supporting undercarriage for intermittent operation in each tamping cycle, thus compacting the ballast in the crib after it has been loosened somewhat by the preceding tamping operation effected by the spreading tamping tools. The operation of the tamping tools is readily visible to the operator so that its monitoring is facilitated.

Figure 2:
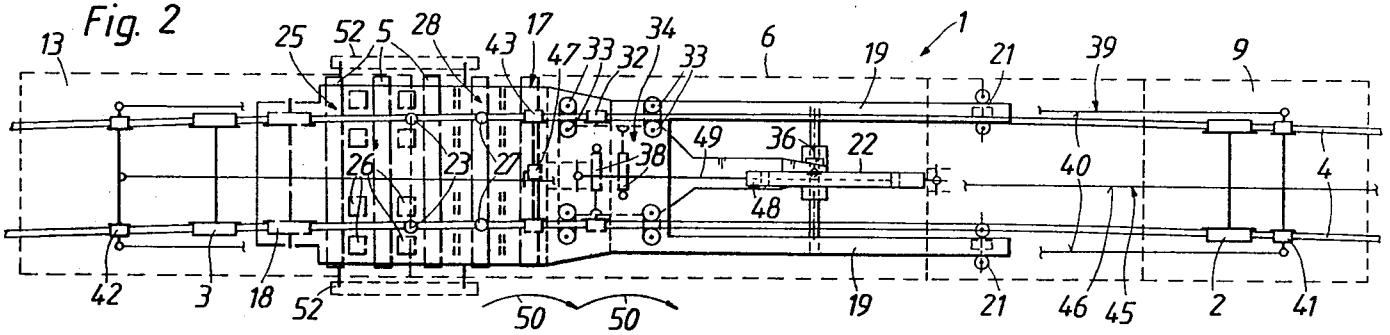
Figure 3:
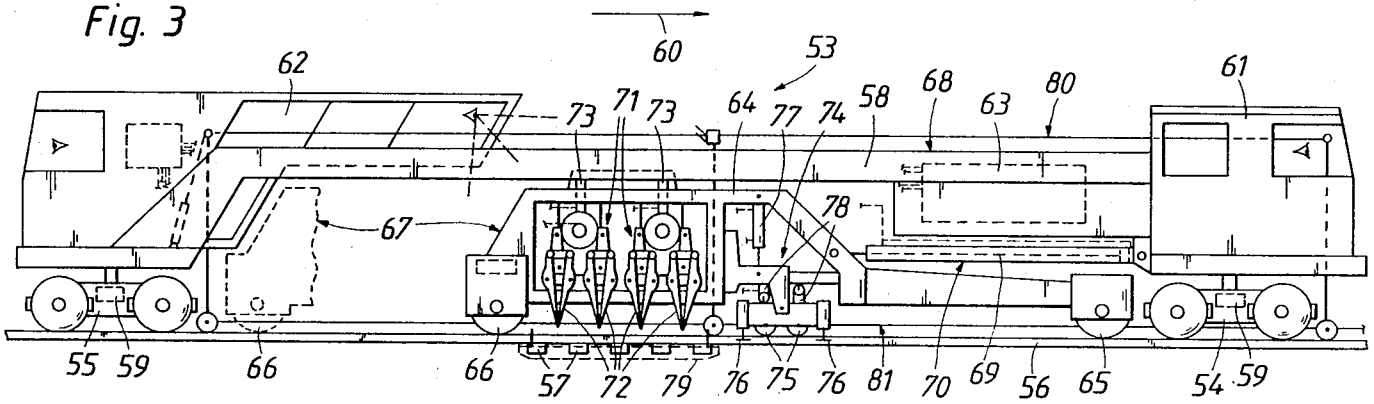
Figure 4:
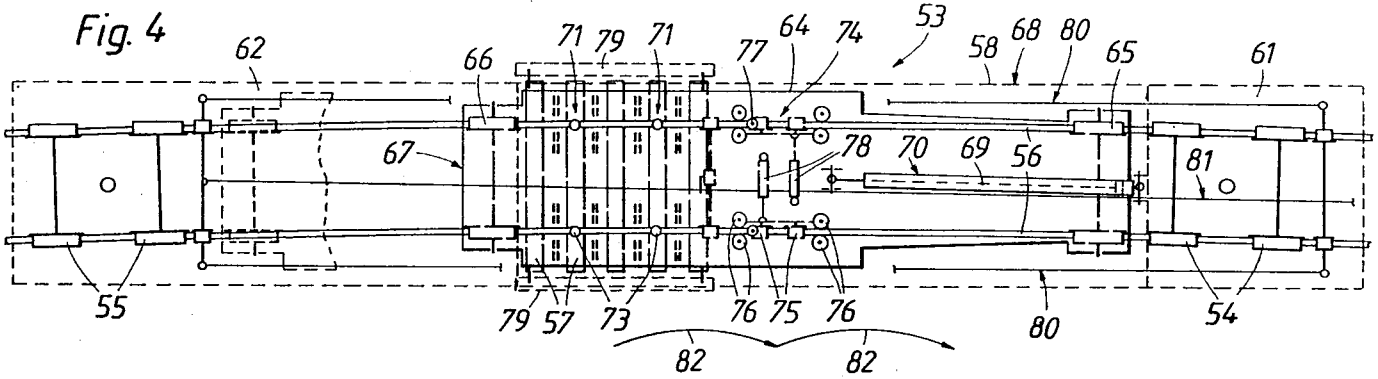
Figure 5:
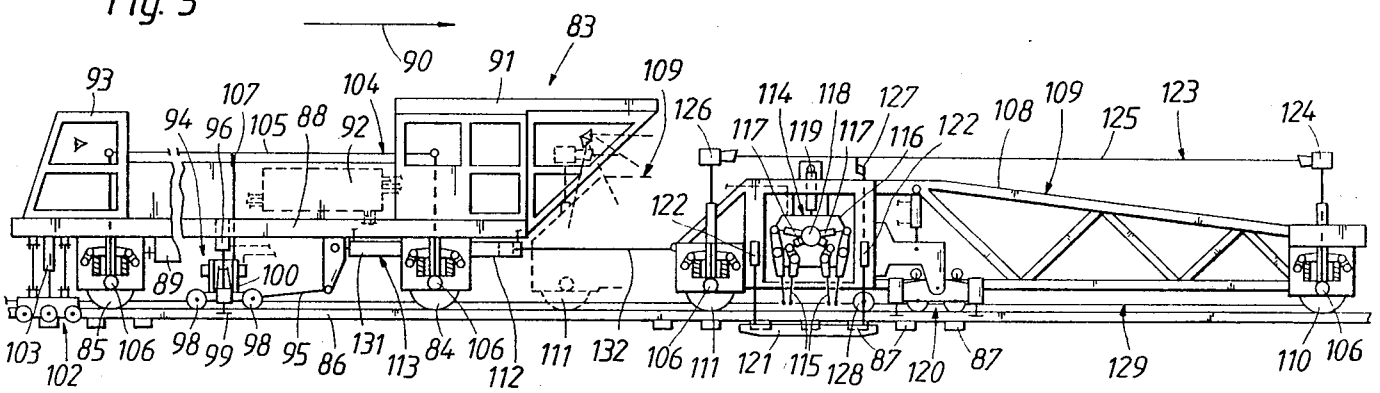
Figure 6:
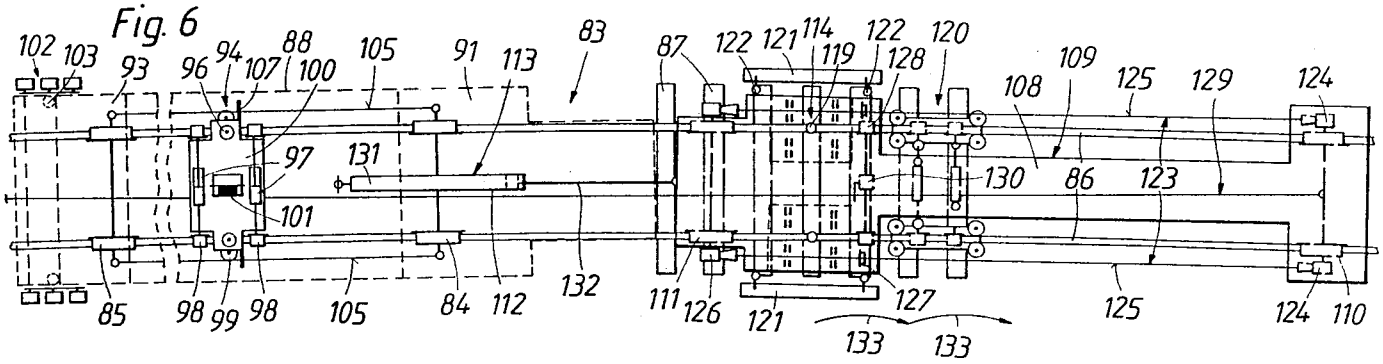

The above and other objects, advantages and features of the present invention will become more apparent from the following detailed description of certain now preferred embodiments thereof, taken in conjunction with the partially schematic accompanying drawing wherein FIG. 1 is a side elevational view of one embodiment of the continuously advancing track leveling, lining and tamping machine of this invention;

FIG. 2 is a diagrammatically simplified top view of the machine of FIG. 1, the machine frame being shown in broken lines for the sake of clarity;

FIGS. 3 and 5 are like side elevational views of two additional embodiments; and FIGS. 4 and 6, respectively, are like top views of the machines of FIGS. 3 and 5.

Referring now to the drawing and first to FIGS. 1 and 2, there is shown continuously advancing machine 1 for leveling, lining and tamping a track consisting of two rails 4 fastened to successive ties 5 resting on ballast defining cribs between the successive ties. Machine 1 comprises machine frame 6 supported on undercarriages 2, 3 for continuous movement in an operating direction indicated by arrow 8. Power plant and operating control means 12 are carried by machine frame 6 behind operator's cab 9 at the front end of the machine frame. The operating control means includes drive means 7 for continuously advancing the machine frame along the track in the operating direction and brake means 11 for stopping the advance of the machine frame. The cab houses drive panel 10. Another operator's cab 13 is mounted on the machine frame at the rear end thereof and houses central control and drive panel 14, brake pedal 15 and a central control 16 connected to panel 14 for automatically controlling the operation of the machine. Another drive panel 10 is mounted at the rear wall of cab 13 to enable the machine to be driven in either direction over open track from one working site to another.

Track leveling, lining and tamping machine 1 further comprises tool carrier frame 17 having a rear end supported on undercarriage 18. The illustrated tool carrier frame has elongated front frame part 20 constituted by two long carrier beams 19 longitudinally adjustably and pivotally supported on machine frame 6 in two roller bearings 21. Longitudinally adjustable coupling 22 pivotally connects tool carrier frame 17 to machine frame 6 for driving the tool carrier frame synchronously with the intermittent tamping cycles. The illustrated coupling is constituted by a hydraulic cylinder-and-piston drive which extends in a plane centrally between the track rails and carrier beams 19, universal joints connecting the ends of the drive to the tool carrier frame and the machine frame, respectively.

This structure of the tool carrier frame is very simple and has the added advantage of keeping the total length of the machine within manageable limits. Although the adjustment path of the intermittently advancing tool carrier frame in relation to the continuously advancing machine frame is relatively long to advance the tool carrier frame by two tie spacings between successive tamping cycles, the distance of the sole supporting undercarriage of the tool carrier frame from the front undercarriage in its forward end position need only be sufficient to permit the track rails to be vertically and/or laterally moved for track correction without being subjected to undue stress. Furthermore, this arrangement provides very good visibility of the operating tools from cab 13 to enable the operation to be visually monitored.

Crib ballast compactors 25 are mounted at the rear end of tool carrier frame 17 just ahead of undercarriage 18 supporting the tool carrier rear end on the track, a respective surface compactor 25 being associated with each rail 4 and being vertically adjustable by drive 23 for vertical movement along guide 24. Each ballast compactor comprises four vibratory compactor shoes 26 contacting the ballast surface in two successive cribs around respective points of intersection between the rails and ties. Immediately ahead of crib compactors 25 and undercarriage 18 supporting the rear tool carrier frame end, in the operating direction, tamping means 28 is mounted on the tool carrier frame for tamping ballast in intermittent tamping cycles under respective ties 5 at points of intersection of the two rails and ties. This tamping means comprises a respective tamping tool assembly vertically movably mounted on tool carrier frame 17, a respective vertical adjustment drive 27 linking each tamping tool assembly to the tool carrier frame. Each tamping tool assembly includes two pairs 29 of vibratory and reciprocatory tamping tools spaced from each other in the operating direction so that each pair 29 of tools is in vertical alignment with a respective one of two successive cribs whereby the tamping tools of each pair may be immersed in the respective cribs upon vertical downward movement of the tamping tool assembly. Reciprocating drive 31 is connected to each pair 29 of tamping tools for pivoting the tools of each pair in opposite directions for spreading towards a respective tie 5 defining the crib wherein the pair of tools is immersed. Central vibrating drive 30 is connected to both pairs of tamping tools for vibrating the same.

Track lifting and lining means 34 associated with the two rails 4 is mounted on tool carrier frame 17 ahead of tamping means 28 in the operating direction and is arranged on the tool carrier frame between undercarriages 18 and 2 spaced in the direction of the track. As is generally conventional, the track lifting and lining means comprises flanged lining rollers 32 engaging the two rails and arranged between two pairs of lifting rollers 33 which are pivotal into clamping engagement with the respective rails. The lining and lifting rollers are mounted on a carriage whose front end is universally linked to bracket 35 affixed to elongated front frame part 20 for pivoting about axis 36 extending transversely to the machine elongation and an axis extending perpendicularly thereto. Lifting drives 37 and lining drives 38 connect the carriage of the track lifting and lining means to tool carrier frame 17.

Track leveling reference system 39 and lining reference system 45 control track lifting and lining means 34 in a generally conventional manner. The illustrated leveling reference system comprises respective reference wire 40 associated with each rail 4 and having a front end supported in the uncorrected track section on track sensing element 41 and a rear end supported in the corrected track section on track sensing element 42. Control track position sensing element 43 is mounted on tool carrier frame 17 between tamping means 28 and track lifting and lining means 34, this sensing element including measuring sensor 44, such as a rotary potentiometer, associated with each rail for cooperation with the reference wire and generating a leveling control signal. The lining reference system comprises reference wire 46 extending from a front measuring bogie in the uncorrected track section (not shown in the drawing) to rear track sensing element 42 and a further measuring sensor 47 carried by track sensing element 43 measures the track ordinate to generate a lining control signal.

The operation of machine 1 will partly be obvious from the above description of the structure thereof and will be explained hereinabove more fully.

The rearmost end position of tool carrier frame 17 in relation to machine frame 6 has been shown in full lines in the drawing, while its foremost end position has been indicated in broken lines. The rearmost end position corresponds to the completion of a tamping cycle of maximum duration wherein the track has been leveled and lined by track lifting and lining means 34 under the control of reference systems 39 and 45, ballast has been tamped under the ties defining two successive cribs by tamping tool pairs 29 of tamping means 28, the ballast in two succeeding cribs has been compacted by vibratory compactor shoes 26, and the tamping tool assemblies 28 as well as crib compactors 25 have been raised by drives 27 and 23, respectively. As soon as rear undercarriage 3 of continuously advancing machine frame 6 has approached rear undercarriage 18 of tool carrier frame 17 to define a pre-set safety distance therebetween, hydraulic fluid pressure is supplied to cylinder chamber 48 of coupling drive 22, either by the manual operation of controls at control panel 14 or, preferably, automatically by central control 16. This causes piston rod 49 of drive 22 to advance the tool carrier frame rapidly by two tie spacings to center the pairs of tamping tools properly in the two succeeding cribs. This intermittent advance of tamping tool carrier 17 has been symbolized by arrow 50 in FIG. 2. The proper centering of tamping means 33 and the subsequent immersion of the tamping tools in the cribs may be visually observed and monitored by an operator in cab 13 (as symbolized by eye 51), who merely needs to look at the immersion of the closed pairs of tamping tools in the successive cribs at respective sides of a tie. When the tamping tools have been properly centered into their tamping position, the cylinder chambers of drive 22 are relieved of pressure, again preferably automatically through central control 16 but, if desired or necessary, manually and brakes 11 are applied to the wheels of undercarriage 18 to halt the tool carrier frame while the machine frame continues to advance (which relative movement is possible because there is no pressure in the cylinder chambers of drive 22). This initiates the next tamping cycle, as hereinabove described.

The drawing also shows (in broken lines) vibratory surface compactors 52 for compacting the ballast at the ends of the ties, i.e. the shoulders of the track, and these vertically adjustable surface compactors are lowered into contact with the ballast and vibrated during each tamping cycle. The combined effect of shoulder compactors 52 and crib compactors 25 creates a closed, C-shaped compacted ballast zone around the tamped points of intersection between the rails and ties, which very effectively fixes the track in its corrected position.

FIGS. 3 and 4 illustrate track leveling, lining and tamping machine 53 whose machine frame 58 is supported on swivel trucks 54, 55 for continuous movement along a track consisting of two rails 56 fastened to successive ties 57. In this embodiment, the wheels of both undercarriages 54, 55 are driven by drives 59 to advance machine frame 58 in an operating direction indicated by arrow 60. As in the embodiment of FIG. 1, both ends of the machine frame carry operator's cabs 61, 62 housing suitable control panels, and power plant and operating control means 63 are mounted in the front part of machine frame 58.

Machine frame 58 constitutes continuously advancing mother vehicle 68 and tool carrier frame 64 constitutes intermittently advancing satellite vehicle 67 independently supported on the track by undercarriages 65, 66 respectively supporting a front and rear end of the tool carrier frame, the two undercarriages forming a relatively long wheelbase for the satellite vehicle. Double-acting hydraulic cylinder-and-piston drive, whose ends are universally linked to the tool carrier frame and the machine frame, respectively, constitute the sole connection therebetween. Because of the substantial mechanical separation of the intermittently advancing tool carrier frame from the continuously advancing machine frame, the machine frame is relieved of the considerable static and dynamic stresses generated by the great weight and operating forces of the twin tampers and the track lifting and lining means. This significantly reduces wear and tear not only on the mother vehicle but on the operators riding thereon, thus increasing the efficiency of the operation and the quality of the work.

The tamping means comprises two tamping tool assemblies 71 associated with each rail 56 and arranged immediately adjacent each other, the pairs 72 of tamping tools of adjacent tamping tool assemblies 71 being so spaced that they are in vertical alignment with four successive cribs. The tamping tool assemblies have the same structure as those of FIG. 1 and each tamping tool assembly 71 is independently vertically adjustable by respective drive 73 so that, if there is some obstacle in the way to make the operation of one of the tamping tool assemblies impossible, the other tamping tool assembly may be immersed in the ballast and operated independently. This arrangement doubles the work of the machine during each tamping cycle and further enhances the operating efficiency because only a single centering of the tamping tools, braking and driving is required for each tamping cycle encompassing tamping ballast under five successive ties.

It will be particularly advantageous to use the standard tamping tool assembly disclosed in my U. S. Pat. No. 4,404,913 since its structure is simple and exceedingly compact, thus saving precious space and making it possible to reduce the length of the wheelbase of the tool carrier frame and, correspondingly, the overall length of the machine. Therefore, the use of this type of tamping tool assemblies has unexpected advantages in the continuously advancing tamper herein disclosed since the relative movement between the tool carrier frame and the machine frame imposes limitations on the available space. Using standard tamping tool assemblies with asynchronous reciprocation of the tamping tools of each pair has the advantage that each tool will continue its tamping movement until a pre-set degree of ballast compaction has been reached.

Track lifting and lining means 74 comprises two flanged lining rollers 75 mounted between two pairs of clamping rollers 76 for engagement with each rail for lining and lifting the track, lifting drive 77 and lining drive 78 linking the track lifting and lining means to the tool carrier frame. The machine also has vertically adjustable vibratory ballast compactors 79 extending over the entire length of the tamping zone to compact the shoulder ballast to provide a compacted ballast zone laterally adjacent the tie ends while rear undercarriage 66 of the tool carrier frame transmits the weight of this frame to the track for compacting the ballast behind the tamping zone. Track leveling system 80 and lining system 81 are similar to the reference systems described in connection with FIGS. 1 and 2.

Hydraulic cylinder-and-piston drive 69 pivotally connects the mother and satellite vehicles and enables the satellite vehicle to be longitudinally moved in relation to mother vehicle 68 between a rearmost end position shown in broken lines and a foremost end position shown in full lines. The operating cycle of machine 53 differs from that of machine 1 only in that rear tamping tool assembly 71 closer to undercarriage 66 is used for tamping, instead of surface compactors 25 and the path of the intermittent advance of the tool carrier frame, symbolized by arrows 82, has twice the length of that of the tool carrier frame of machine 1.

In track leveling, lining and tamping machine 83 of FIGS. 5 and 6, machine frame 88 of the mother vehicle is supported on single-axle front and rear undercarriages 84, 85 for continuously advancing along a track consisting of rails 86 fastened to ties 87 in an operating direction indicated by arrow 90. Drive 89 acts on the wheels of rear undercarriage 85 to advance machine frame 88 continuously. The machine frame has a front portion overhanging front undercarriage 84 and operator's cab 91 is carried by this front machine frame portion, power plant and operating control means 92 being carried on the machine frame rearwardly of cab 91. Another operator's cab 93 is carried at the rear end of machine frame 88 to enable a driver in this cab to move the machine in a direction opposite to the operating direction for movement of the machine between working sites. This machine also carries as auxiliary equipment a track stabilization unit 94 mounted between the undercarriages of relatively short machine frame 88 and, as is entirely conventional, connecting rod 95 connects the track stabilization unit to the machine frame for advance therewith while vertical pressure drives 96 in alignment with each rail 86 link unit 94 to the machine frame. This standard track stabilization unit comprises two pairs of flanged rollers 98 pressed against the gage sides of the rail heads by spreading drives 97, the rail heads being gripped by pivotal clamping rollers 99 at the field sides thereof to hold the track rails in a firm vise while vibratory drive 101 imparts horizontal vibrations thereto and drive 96 exerts a vertical load on carriage 100 of track stabilization unit 94.

Furthermore, surface shoulder compactors 102 are linked to machine frame 88 at the rear end thereof and may be vertically adjusted by drives 103 exerting a downward pressure on the compactors to compact the ballast at the ends of the track ties.

Machine frame 88 carries further leveling reference system 104 controlling vertical drive 96 of track stabilization unit 94, reference system 104 comprising two reference wires 105 associated with the track rails and having front and rear ends respectively supported on axle bearings 106 of front and rear undercarriages 84, 85, control signal emitters 107 mounted on unit 94 cooperating with reference wires 105.

Tool carrier frame 108 constitutes an intermittently advancing satellite vehicle 109 preceding the overhanging front portion of machine frame 88, in the operating direction. The tool carrier frame is a spatial framework whose front and rear ends are supported on single-axle undercarriages 110, 111. Longitudinally adjustable hydraulic cylinder-and-piston drive 112 is a coupling 113 constituting the sole connection between the tool carrier frame and the machine frame, universal joints connecting the respective ends of the coupling to the frames. The tamping means is mounted on tool carrier frame 108 immediately ahead of rear undercarriage 111 and comprises twin spreading tamping tool assemblies 114 associated with track rails 86. The structure of tamping tool assemblies 114 differs from that of the previously described embodiments and has the form disclosed in my U.S. Pat. No. 4,094,250, the two pairs 115 of tamping tools being in alignment with two successive cribs and the tamping tools being mounted on tamping tool carrier 116. Separate reciprocating drives 117 connect each tamping tool to central vibrating drive 118. Vertical adjustment drive 119 links tamping tool carrier 116 to tool carrier frame 108 for lowering the tamping tools into the ballast.

Track lifting and lining means 120 of the same type as hereinabove described precedes the tamping means and, as in the other embodiments, shoulder surface compactors 121 are mounted on satellite vehicle 109 and are linked to tool carrier frame 108 by vertical drives 122.

In this embodiment, the freedom of movement of the intermittently advancing satellite vehicle in relation to the continuously advancing mother vehicle is limited only by the length of the adjustment path of longitudinally adjustable coupling 112 while the operator's cab is so located as to enable an operator to monitor the work visually without being subjected to the vibrations and noise emanating from the operating tools and without his view being obstructed by any structural portion of the mother vehicle. In addition, both vehicles may have relatively short wheelbases so that single-axle undercarriages provide favorable conditions for operating the vehicles in curves.

A separate optical leveling reference system 123 is carried on satellite vehicle 109 and comprises, per rail 86, sender 124 emitting sharply focussed light beam 125 and receiver 126 aligned with the sender to receive the light beam, the senders and receivers being supported, respectively, on axle bearings 106 of front and rear undercarriages 110, 111 of the satellite vehicle. Shadow boards 127 cooperate with the light beams for controlling the track level, the shadow boards being mounted on track sensing element 128 between tamping means 114 and track lifting and lining means 120. Finally, track leveling, lining and tamping machine 83 also is equipped with schematically illustrated lining reference system 129 constituted by a rod extending from front undercarriage 110 of the satellite vehicle to a measuring bogie (not shown) trailing the machine in the corrected track section. Track ordinate sensor 130 mounted on track sensing element 128 cooperates with the reference rod to control lining of the track.

FIG. 5 shows satellite vehicle in its foremost end position in full lines while its rearmost end position in relation to machine frame 88 is indicated in broken lines. In its foremost or operating position, the satellite vehicle centers tamping tool assemblies 114 with respect to the ties to be tamped at the beginning of a tamping cycle. No pressure is applied to the cylinder chambers of hydraulic cylinder-and-piston drive 112 while vertical adjustment drives 119 and 122 are actuated to lower tamping tool assemblies 114 for immersion of the tamping tools into the ballast and ballast compactors 121 for surface contact with the ballast adjacent the tie ends, track lifting and lining means 120 is operated under the control of leveling and lining reference systems 123 and 129 to correct the track position, and reciprocating drives 117 and vibrating drive 118 are actuated to spread the tamping tools of pairs 115 and to vibrate the tools for tamping the ballast under the adjacent ties. During this tamping cycle, the satellite vehicle stands still while drive 89 continues to impart a constant forward speed to machine frame 88 of the mother vehicle in the operating direction indicated by arrow 90. During this continuous advance of the mother vehicle, vibrating drive 101 and vertical load imparting drive 96 of track stabilization unit 94 are operated to vibrate the track in a horizontal direction and press it into the ballast in a vertical direction, thus settling the track and stabilizing its corrected position. The degree of settling is controlled by additional leveling reference system 104 in the following manner:

As soon as one track rail 86 has been brought down to the finally desired level by the operation of track stabilization unit 94, level control element 107 associated with this rail is out of contact with reference wire 105. This reference wire is part of an electric control circuit so that control element 107 operates like a switch which opens the circuit when it is out of contact with the reference wire. The control circuit operates a solenoid valve arrangement for controlling the flow of hydraulic fluid to drive 96 and, when the circuit is opened, the valve arrangement leaves the drive without pressure so that no further vertical load is applied to the one track rail. This final track position is further solidified by the load applied thereto by rear undercarriage 85 of the mother vehicle and shoulder compactors 102 pressed downwards against the ballast at the ends of the ties by drives 103.

After the tamping cycle has been completed, drives 119 and 122 are actuated to raise tamping tool assemblies 114 and shoulder compactors 121. Simultaneously and, preferably, automatically under the control of limit switch means responsive to the raising of the tamping tool assemblies, hydraulic fluid pressure is applied to cylinder chamber 131 of coupling drive 112 so that piston rod 132 of the drive rapidly pulls satellite vehicle 109 forwards, as symbolically indicated by arrows 133, to center the tamping tools with respect to the succeeding ties 87.

What is claimed is:

1. A continuously advancing machine for leveling, lining and tamping a track consisting of two rails fastened to successive ties resting on ballast defining cribs between the successive ties, which comprises (a) a machine frame supported on undercarriages for continuous movement in an operating direction, (b) a power plant and operating control means including drive means for continuously advancing the machine frame along the track in the operating direction and brake means for stopping the advance of the machine frame, the power plant and the control means being carried by the machine frame, (c) a tool carrier frame having a rear end supported on an undercarriage, (d) tamping means mounted on the tool carrier frame immediately ahead of the undercarriage supporting the rear tool carrier frame end, in the operating direction, for tamping ballast in intermittent tamping cycles under respective ones of the ties at points of intersection of the two rails and the respective ties, (1) the tamping means at a fixed distance therefrom comprising a respective tamping tool assembly associated with each rail, each tamping tool assembly being vertically movably mounted on the tool carrier frame and including two pairs of vibratory and reciprocatory tamping tools spaced from each other in the operating direction so that each pair of tools is in vertical alignment with a respective one of two successive ones of the cribs whereby the tamping tools of each pair may be immersed in the respective cribs upon vertical downward movement of the tamping tool assembly, and the tools of each pair being pivotal in opposite directions for spreading towards a respective one of the ties defining the crib, (e) track lifting and lining means associated with the two rails mounted on the tool carrier frame ahead of the tamping means in the operating direction and being arranged on the tool carrier frame between two of said undercarriages spaced in the direction of the track, (f) track leveling and lining reference systems controlling the track lifting and lining means, and (g) a longitudinally adjustable coupling pivotally connecting the tool carrier frame to the machine frame for driving the tool carrier synchronously with the intermittent tamping cycles.

2. The continuously advancing track leveling, lining and tamping machine of claim 1, wherein only the rear end of the tool carrier frame is supported on the track and the tool carrier frame has an elongated front frame part longitudinally adjustably and pivotally supported on the machine frame.

3. The continuously advancing track leveling, lining and tamping machine of claim 1, comprising a further undercarriage supporting a front end of the tool carrier frame, the coupling constituting the sole connection between the tool carrier and machine frames whereby the machine frame constitutes a continuously advancing mother vehicle and the tool carrier frame constitutes an intermittently advancing satellite vehicle pivotally coupled to the mother vehicle and longitudinally adjustable in relation thereto.

4. The continuously advancing track leveling, lining and tamping machine of claim 3, wherein the machine frame of the mother vehicle is supported on front and rear undercarriages and has a front portion overhanging the front undercarriage, and the satellite vehicle precedes the overhanging machine frame front portion, in the operating direction.

5. The continuously advancing track leveling, lining and tamping machine of claim 1, comprising two of said tamping tool assemblies associated with each rail and arranged immediately adjacent each other, the pairs of tamping tools of the adjacejt tamping tool assemblies being so spaced that they are in vertical alignment with four successive ones of the cribs.

6. The continuously advancing track leveling, lining and tamping machine of claim 5, wherein each one of the tamping tool assemblies is independently vertically adjustable.

* * * * *